US007742613B2

(12) United States Patent
Dittli

(10) Patent No.: US 7,742,613 B2
(45) Date of Patent: Jun. 22, 2010

(54) CONNECTING MEANS FOR HOUSINGS OF HEARING DEVICES

(75) Inventor: Erich Dittli, Reichenburg (CH)

(73) Assignee: Phonak AG, Staefa (CH)

( * ) Notice: Subject to any disclaimer, the term of this patent is extended or adjusted under 35 U.S.C. 154(b) by 1036 days.

(21) Appl. No.: 11/425,480

(22) Filed: Jun. 21, 2006

(65) Prior Publication Data

US 2007/0297628 A1 Dec. 27, 2007

(51) Int. Cl.
*H04R 25/00* (2006.01)

(52) U.S. Cl. ..... 381/322; 381/324; 381/328; 381/330

(58) Field of Classification Search ..... 381/322, 381/324, 328, 330
See application file for complete search history.

(56) References Cited

U.S. PATENT DOCUMENTS 4,354,065 A * 10/1982 Buettner ..... 381/330
5,204,917 A * 4/1993 Arndt et al. ..... 381/324
6,305,892 B1 10/2001 Qiao

FOREIGN PATENT DOCUMENTS

| | | |
|---|---|---|
| DE | 18 11 379 A1 | 6/1970 |
| DE | 3309954 A1 | 9/1984 |
| EP | 1 341 397 A2 | 2/2003 |

OTHER PUBLICATIONS

Interantional Search Report dated Feb. 27, 2007.

* cited by examiner

*Primary Examiner*—Suhan Ni
(74) *Attorney, Agent, or Firm*—Pearne & Gordon LLP

(57) ABSTRACT

The present invention provides a connecting means for hearing devices having a housing, said housing comprising at least two shells (1;2) to be connected to each other, said connecting means comprising a single-piece pin (6), extending straight along its longitudinal axis (L) and having retaining surfaces (9) arranged at the region of both ends of said pin and being tapered outwardly towards the outside of both ends of said pin (6). Said pin (6) may thus be inserted into two proximately adjacent arranged openings or bores (7) of the shells (1;2) serving as connecting means.

11 Claims, 1 Drawing Sheet

CONNECTING MEANS FOR HOUSINGS OF HEARING DEVICES

TECHNICAL FIELD

The present invention relates to connecting means for housings of hearing devices and to housings of hearing devices.

BACKGROUND OF THE INVENTION

Hearing devices, such as hearing aids, are usually placed within housings comprising of at least two shells. The shells are connected to each other to form the assembled, closed housing of the hearing device.

Screws are commonly used for the connection of such shells. If the shells are made of plastic, so called self-cutting screws may be used. Such self-cutting screws do not need to be inserted into threads, in contrary to regular screws, but only need a bore with a smaller diameter than the diameter of the screw thread. Cutting surfaces are provided at the coin point of such a screw for cutting themselves into the bore and thus producing themselves a thread.

Regular screws engaging into nuts may alternatively be used, said nuts being provided within receiving openings at the inside of the shells.

For both known solutions described above, the screw head is visible from the outside of the housing because the screw has to be operated from the outside. Thus, those solutions are unconvincing and the respective openings for the screws at the outside of the housing are subject to contamination.

Alternative housings are known with shells that are connected via pins with a smooth surface. Such housings are separated parallel with respect to the axis of the pins in contrary to housings with screws that are separated transversally with respect to the axis of the screws. The design of the shells are therefore more complex involving more expensive injection molding tools in contrary to common shells for screws. That arises from the characteristic of the pins to be stressed only transversally to its longitudinal axis. Thus, eyelets have to be provided at the shell for receiving the pins that rises the complexity of the injection molding tools. Furthermore, the pin heads are visible from the outside and the respective receiving bores tend to collect dirt even though they are smaller in diameter with respect to the bores used for screws.

Further solutions are known with shells that interconnect via resilient tongues with hooks. The hooks of said tongues interlock with engaging means arranged at the shell after assembling of the shells. The respective injection molding tools to form such means are as well complex and therefore expensive. Furthermore, such connections are usually not very stable or robust. The hooks, tongues and/or engaging means will often be damaged when opening the housing or already by closing the shells of the housing. A further disadvantage lies in the fact that such connecting means usually require a lot of space that has a negative impact onto the dimension of the housing which is usually required to be highly miniaturized.

SUMMARY OF THE INVENTION

It is an object of the present invention to provide a connection means for the connection of the shells of the housing of hearing devices, thereby eliminating the mentioned disadvantages of the known housings.

It is a further object of the present invention to provide a connection means that is only barely visible or completely invisible from the outside of the housing and that does not need any opening at the outside of the housing.

The present invention provides a connecting means for hearing devices having a housing, said housing comprising at least two shells to be connected to each other, said connecting means comprising a single-piece pin, extending straight along its longitudinal axis and having retaining surfaces arranged at the region of both ends of said pin and being tapered outwardly towards the outside of both ends of said pin. Said pin may be inserted into two proximately adjacent arranged openings or bores of the shells serving as connecting means. Those pins will penetrate into said openings or bores by pressing the shells together. The retaining surfaces will thereby snuggel to the inside wall of the respective openings or bores and are thus tied positively with the shells thereby providing a friction-locked connection of the shells in its closed state.

The pin itself is not visible from the outside in the closed state of the housing, as the openings or holes are arranged at the inside of the shells and provided as blind holes. Therefore, there is no risk of being contaminated by dust or mud.

As further advantage, the required space for such connecting means is relatively small, as they may be arranged transversally to the connecting flanges of the shells. By using multiple pins for the connection of the shells, a stable and robust connection is provided.

In one embodiment, said pin is provided with a medium part with a cylindrical surface. That allows a precise and clearance-free positioning and assembling of the shells.

In another embodiment, said pin having at least two retaining surfaces arranged at intervals along the longitudinal axis at the region of each end of said pin. The friction-locked connection will thereby be increased, as the friction surface is greater, and thus the shells are secured against unintentional or accidental opening of the housing.

In a further embodiment, three retaining surfaces are arranged at intervals along the longitudinal axis at the region of each end of said pin In another embodiment, said retaining surface is provided by a conical or coil shaped surface circumferentially arranged at said pin. This causes an extraordinary clamping effect at the whole periphery of the opening or bore respectively. Furthermore, the symmetric design of the retaining surfaces of the connecting means may be produced cost-efficient with simple tools in great numbers.

In a further embodiment, the end portion of said retaining surface directed towards the mid-part of said pin has a sharp edge. This sharp edge may be arranged essentially rectangular with respect to the longitudinal axis of said pin. The loosening of the pin contrary to the insertion direction will thus be prevented in addition to the radially acting friction force of the retaining surfaces.

In another embodiment, the connecting means are composed of plastic. That enables a cost-efficient production by an injection molding process.

The present invention further provides a hearing device having a housing, said housing comprising at least two shells to be connected to each other by connecting means. Said connecting means comprising a single-piece pin, extending straight along its longitudinal axis and having retaining surfaces arranged at the region of each end of said pin and being tapered outwardly towards the outside of each end of said pin. Said shells further comprising a plurality of openings, arranged transversally with respect to the connecting flanges of said shells and provided pairwise opposite to each other along an axis on said shells for receiving a dedicated pin. By arranging the axis of the openings transversally with respect to the connecting flanges of the shells only a minimum amount of space is needed for those connecting means. As the openings are arranged at the inside of the shells, they are not visible from outside of the shell or the housing in its assembled state respectively. Such openings are easily integrated into the tool form for the shells and are thus easy to manufacture. Furthermore, the locations of the openings may be chosen with a high degree of freedom taking into account the other elements to be arranged within the hearing device housing, nevertheless enabling a stable and strong connection of the shells.

A further advantage lies in the fact that the amount of space needed for the connecting means is not greater compared to the amount of space needed by common resilient snap-in connections, whereas the strength and stability is much higher compared to the common resilient snap-in connections.

In a further embodiment, the openings have circular or polygonal cross-sections, each having at least two different cross section dimensions along its depth, wherein the first cross section dimension near the aperture is greater then the following second cross section dimension. Such openings may be easy manufactured and facilitates the insertion of the connecting means or the cone ends of the pins respectively.

In another embodiment, the first cross section dimension is equivalent to the diameter of the mid-section of said pin and the second cross section dimension is smaller than the greatest diameter of said retaining surfaces of said pin. This design enables a high fitting accuracy during the manufacturing or assembling of the shells respectively and allows a connection free of clearance due to the mid-section of the pins.

The assembling of the shells is conceivable easy as first of all the connecting means have to be inserted into the openings of one shell and subsequently the second shell has to be positioned opponent to the first shell and then be pressed against said first shell, thereby inserting the free ends of the connecting means into the respective openings of the second shell.

It has to be noted that hearing device according the present invention means every device in connection with the recording and processing of sound and reproduction to the ear, such as earphones, ear protection, hearing aids and BTE (behind-the-ear) hearing aids.

DESCRIPTION OF THE DRAWINGS

For purpose of facilitating and understanding of the invention, a preferred embodiment thereof is illustrated in the accompanying drawings to be considered in connection with the following description. Thus the invention may be readily understood and appreciated.

DESCRIPTION OF A PREFFERED EMBODIMENT

Figure 1:
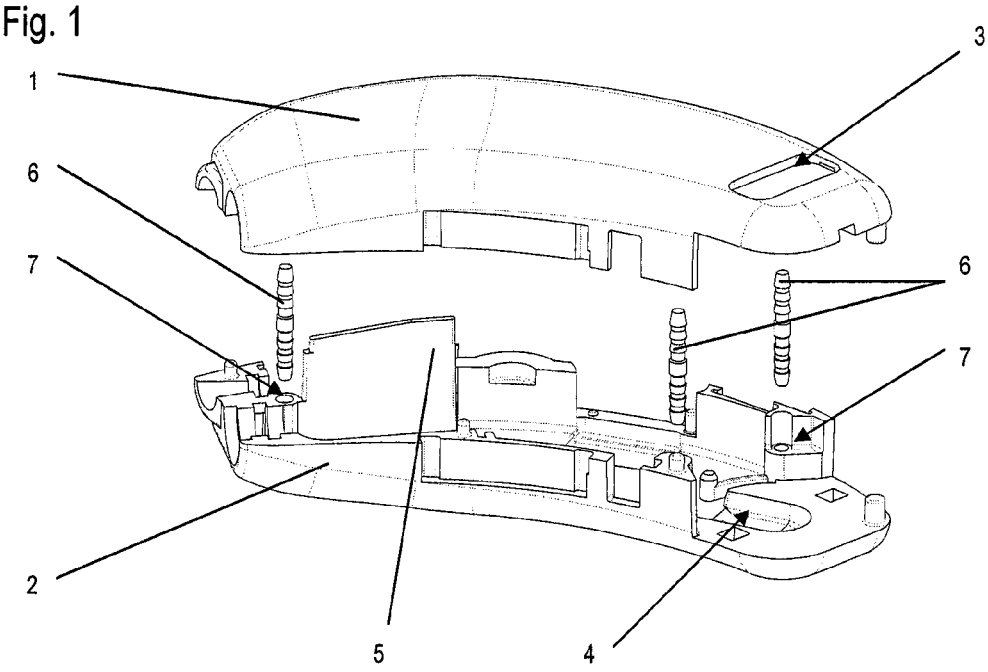
FIG. 1 is the view onto an open hearing device comprising of two shells with connecting means.

Referring to FIG. 1, the upper shell 1 and the lower shell 2 of a hearing aid of the type of BTE (Behind-the-ear) hearing aid is shown in its open state.

The shells 1, 2 have common apertures 3 on its outside and recesses 4 and bars 5 on its inner side for receiving the electrical or mechanical components of the hearing device (not shown in FIG. 1).

Three pin-formed connecting means 6 are provided for the connection of the two shells 1 and 2, each insertable into openings 7 arranged at the inside of the shells 1 and 2.

Figure 2:
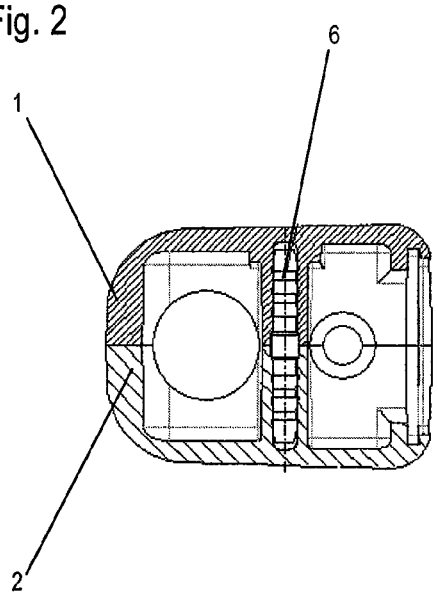
FIG. 2 is a cross sectional view through the hearing device of FIG. 1 in its assembled state in the area of a connecting means.

FIG. 2 depicts the cross sectional view of the assembled hearing device according FIG. 1 in the area of a connecting means 6. Hence the relative small amount of space needed on one hand and the high load capacity or strength respectively due to the high amount of connecting surface on the other hand is revealed.

Figure 3:
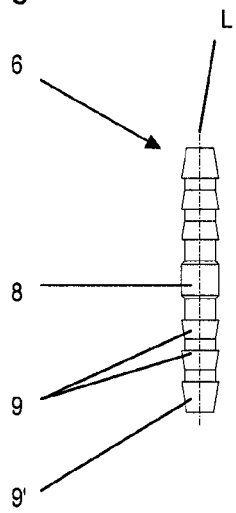
FIG. 3 is the view of an inventive connecting means.

FIG. 3 depicts in more details the view of an inventive connecting means 6, showing the cylindrical mid-part 8, which outer diameter is slightly greater than the greatest diameter of the conical formed retaining surfaces 9. Three circumferential conical surfaces 9 are arranged on each side of the mid-part 8. The outermost conical surface 9' is slightly longer than the rest of the conical surfaces and has a slightly minor inclination with respect to the longitudinal axis L. This facilitates the insertion of the connection means 6 into the appropriate opening 7.

What is claimed is:

1. Connecting means for hearing devices having a housing, said housing comprising at least two shells (1;2) to be connected to each other, said connecting means comprising a single-piece pin (6), extending straight along its longitudinal axis (L) and having retaining surfaces (9) arranged at the region of both ends of said pin (6) and being tapered outwardly towards the outside of both ends of said pin (6).

2. Connecting means according to claim 1 wherein said pin (6) is provided with a mid-part with a cylindrical surface (8).

3. Connecting means according to claim 1 wherein said pin (6) having at least two retaining surfaces (9;9') arranged at intervals along the longitudinal axis (L) at the region of each end of said pin (6).

4. Connecting means according to claim 3 wherein said pin (6) having three retaining surfaces (9;9') arranged at intervals along the longitudinal axis (L) at the region of each end of said pin (6).

5. Connecting means according to claim 1 wherein said retaining surface (9) is provided by a conical or coil shaped surface circumferentially arranged at said pin (6).

6. Connecting means according to claim 1 wherein the end portion of said retaining surface (9) directed towards the mid-part of said pin (6) has a sharp edge.

7. Connecting means according to claim 6 wherein said sharp edge is arranged essentially rectangular with respect to the longitudinal axis (L) of said pin (6).

8. Connecting means according to one of claims 1 to 7 being composed of plastic.

9. Hearing device having a housing, said housing comprising at least two shells (1;2) to be connected to each other by connecting means, said connecting means comprising a single-piece pin (6), extending straight along its longitudinal axis (L) and having retaining surfaces (9) arranged at the region of both ends of said pin (6) and being tapered outwardly towards the outside of both ends of said pin (6), said shells (1;2) comprising a plurality of openings (7), arranged transversally with respect to the connecting flange of said shells (1;2) and provided pairwise opposite to each other along one axis for receiving a dedicated pin (6).

10. Hearing device according to claim 9 wherein the openings (7) have circular or polygonal cross-sections, each having at least two different cross section dimensions along its depth, wherein the first cross section dimension near the aperture is greater then the following second cross section dimension.

11. Hearing device according to claim 10 wherein the first cross section dimension is equivalent to the diameter of the mid-section of said pin (6) and the second cross section dimension is smaller than the greatest diameter of said retaining surfaces (9;9') of said pin (6).

* * * * *